US008596830B2

(12) United States Patent
du Plessis

(10) Patent No.: US 8,596,830 B2
(45) Date of Patent: Dec. 3, 2013

(54) INDIRECT LIGHTING SYSTEM

(75) Inventor: Urbain du Plessis, Colingwood (AU)

(73) Assignee: Hella KGAA Hueck & Co., Lippstadt (DE)

( * ) Notice: Subject to any disclaimer, the term of this patent is extended or adjusted under 35 U.S.C. 154(b) by 270 days.

(21) Appl. No.: 13/254,713

(22) PCT Filed: Mar. 3, 2010

(86) PCT No.: PCT/EP2010/052643

§ 371 (c)(1),
(2), (4) Date: Sep. 2, 2011

(87) PCT Pub. No.: WO2010/100166

PCT Pub. Date: Sep. 10, 2010

(65) Prior Publication Data

US 2012/0044694 A1 Feb. 23, 2012

(30) Foreign Application Priority Data

Mar. 3, 2009 (AU) ..... 2009900949

(51) Int. Cl.
*F21V 33/00* (2006.01)

(52) U.S. Cl.
USPC ..... 362/296.1; 362/33; 362/297; 362/342; 362/346

(58) Field of Classification Search
USPC ..... 362/296.01, 297, 300, 263, 296.09, 362/296.1, 342, 346, 33
See application file for complete search history.

(56) References Cited

U.S. PATENT DOCUMENTS

| | | | | |
|---|---|---|---|---|
| 3,671,735 | A | 6/1972 | King | |
| 7,891,824 | B2 * | 2/2011 | Huang | 353/99 |
| 2001/0003506 | A1 * | 6/2001 | Natsume | 362/518 |
| 2003/0053314 | A1 * | 3/2003 | Summerford et al. | 362/342 |

FOREIGN PATENT DOCUMENTS

| | | | |
|---|---|---|---|
| AU | 2009900949 | | 3/2009 |
| DE | 19821721 | A1 | 11/1999 |
| DE | 20002092 | U1 | 5/2000 |
| EP | 1331437 | A1 | 7/2003 |
| FR | 2834329 | A1 | 7/2003 |
| FR | 2834330 | A1 | 7/2003 |
| WO | 0165170 | A1 | 9/2001 |

OTHER PUBLICATIONS

International Search Report, PCT/EP2010/052643, Nov. 5, 2010.

* cited by examiner

*Primary Examiner* — Laura Tso
(74) *Attorney, Agent, or Firm* — Husch Blackwell LLP; Robert C. Haldiman; H. Frederick Rusche

(57) ABSTRACT

An apparatus where an indirect lighting system is adapted to direct light to a target. The primary optics are arranged to eject a flat beam of uniform intensity light onto an assembly of fractal reflector modules that reflect the beam to the target. The primary optics comprise a light source, and a reflector of stepped facets, located on the surface of a parabolic reflector; the shape and location of each facet being calculated to provide a uniform intensity flat beam.

6 Claims, 7 Drawing Sheets

INDIRECT LIGHTING SYSTEM

RELATED APPLICATIONS

This application claims priority and benefit of Australian Patent Application No. 2009900949, filed Mar. 3, 2009, and, PCT/EP2010/052643, filed Mar. 3, 2010, all of which are incorporated herein by reference.

BACKGROUND OF THE INVENTION

Field of the Invention

This invention relates to indirect lighting systems and in particular, systems that incorporate free form reflectors.

Indirect lighting systems have been known for some years and essentially comprise a primary source of light that is directed towards a reflector that in turn directs the light to a target thus providing an indirect lighting system whereby the light source is hidden from direct view. There are a number of reasons why these systems are used including reducing glare for aesthetic and safety reasons; improving the appearance of the lighting system, avoiding direct view of a light source that is too intense to be safely viewed and locating the light source and its power supply away from the area that has to be illuminated.

The currently available indirect lighting systems suffer from the following problems, the level of illumination is too low, there is little precise beam control and the efficiency of the systems is not a high design priority.

It is these issues that have brought about the present invention.

SUMMARY OF THE INVENTION

According to one aspect of the present invention there is provided an indirect lighting system adapted to direct light to a target, the system comprising:

a) primary optics arranged to eject a flat beam of uniform intensity light onto secondary optics that reflect the beam to the target, the primary optics comprising a light source and a reflector of stepped facets the shape and location of each facet being calculated to provide a uniform intensity flat beam, the secondary optics comprising a free form reflector of fractal design.

Further areas of applicability of the present invention will become apparent from the detailed description provided hereinafter. It should be understood that the detailed description and specific examples, while indicating the preferred embodiment of the invention, are intended for purposes of illustration only and are not intended to limit scope of the invention.

BRIEF DESCRIPTION OF THE DRAWINGS

An embodiment of the present invention will now be described by way of example only with reference to the accompanying drawings in which.

DETAILED DESCRIPTION OF THE PREFERRED EMBODIMENT

Figure 1:
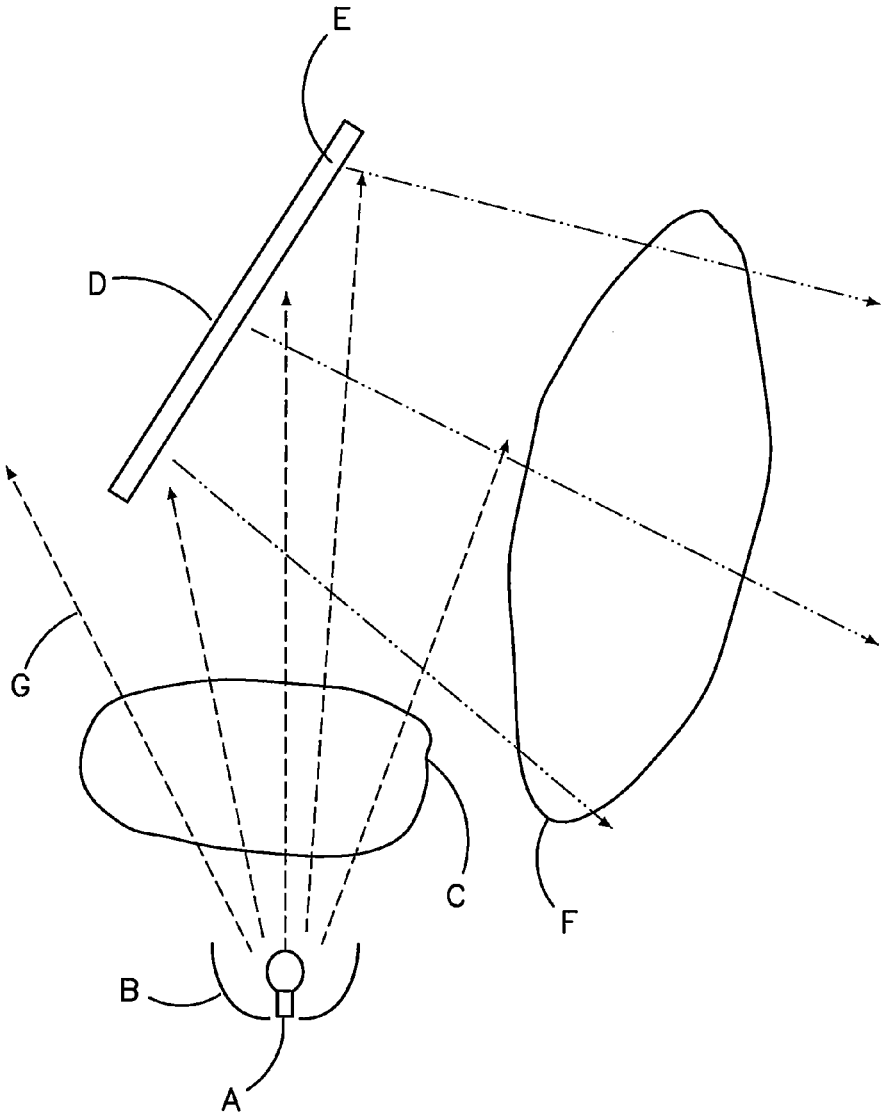
FIG. 1 is a schematic illustration of a conventional indirect lighting system.

In the conventional indirect lighting system shown in FIG. 1, a light source A, typically a high intensity lamp suitable to produce a narrow beam is housed within a conical or parabolic reflector B. The comparatively narrow beam of light is illustrated by the periphery C and this constitutes the primary optics of the indirect lighting system. It is understood that the primary optical system could also include lenses, shields and other devices. The secondary optics D comprises a large reflective surface E that is positioned at some distance from the light source to intersect the primary beam C and redirect the light into a secondary beam F that is directed to a suitable target.

As shown in FIG. 1, some of the primary light G misses the reflector and is lost. It is understood that the secondary reflector E would be finished in a suitable degree of specularity and formed into a shape to suit the particular application. It is further understood that these components would be supported in the housing and other structural appliances as necessary.

Figure 2:
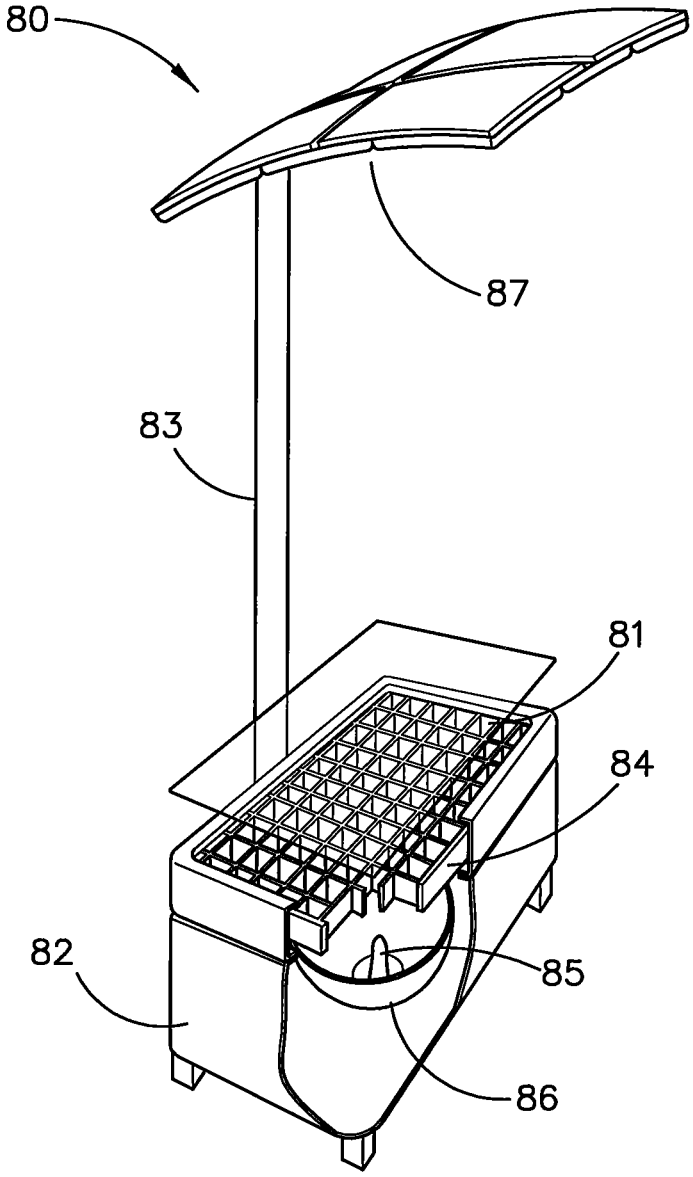
FIG. 2 is a perspective view of an indirect lighting system in accordance with an embodiment of the invention.

In a preferred embodiment of this invention free form reflectors are used in indirect lighting system in both the primary optics or secondary optics. As shown in FIG. 2 the indirect lighting system 80 comprises a rectangular housing 82 that houses primary optics in the form of a light source 85, a (parabolic) reflector 86, a grill 84, and a rectangular screen 81. The housing supports a vertical column 83 that in turn supports the secondary optics 87 that is in the form of a fractal reflector that directs the light to a target, not shown.

Free Form Reflector Technology

Free form reflectors are used in compact automotive lighting, video projector and laser scanning systems. These reflectors are sometimes known as "all clear" reflectors and are designed using a NURBS (Non Uniform Rational Basis Spline) surface for the mathematical modeling of the reflector shape and artificial intelligence as the optimum design algorithm. This is in contrast to conventional reflectors that are generally based on the geometry of classical conical sections (parabola, ellipse, hyperbola etc).

Pioneers of this geometric field developed algorithms to evaluate parametric surfaces. NURBS are a generalization of splines often regarded as uniform non-rotational b splines. Fractal geometry is used to generate an array of reflectors using the NURBS derived complex surface geometry as its basis.

A fractal is generally "a rough or fragmented geometric shape that can be split into parts, each of which is (at least approximately) a reduced-size copy of the whole," a property called self-similarity. A fractal geometrical object generally has the following features:

a) It has a fine structure at arbitrarily small scales; in this application the smallest scale is set by the preferred manufacturing process.

b) It is too irregular to be easily described in traditional Euclidean geometric language.

c) It is self-similar, in this application this aspect is particularly clear because each "cell" of the reflector array produce the same light distribution as the whole array.

d) It has a Hausdorff dimension which is greater than its topological dimension (although this requirement is not met by space-filling curves such as the Hilbert curve).

e) It has a simple and recursive definition, in this application it is the collection of NURBS derived surfaces required to produce the free form reflector surface.

These days it is possible to precision manufacture optical parts using mass production methods like injection molding, using dies that have complex, precise nano scale surfaces fabricated by means of manufacturing techniques such as diamond turning, iron beam milling, computer control machining and fine scaled etching.

In the embodiment shown in FIG. 2, the primary beam from the primary optics is developed using advanced free form reflector design technology. This technology aims to emulate the uniform illumination service received from the sun. The secondary optics, namely the secondary reflector, exploits the uniform illumination features of the primary beam using a free form reflector to deflect that beam to the target by designing the secondary reflector as a fractal system, a large reflector can be constructed as an array of small similar modular standardized interlocking elements. This design allows the use of mass production tools to make the small reflector modules and provides a simple mechanism to assemble the fractal reflector modules into an array.

Primary Optics

As shown in FIG. 1, conventional indirect lighting systems use primary optics that involve a light source and reflectors based on conical sections that could be parabolic, hyperbolic, elliptical or spherical. These assemblies produce light beams that exhibit significant intensity changes within the desired beam which this results in significant changes from point to point on the secondary reflectors. This issue severely limits the design freedom of the secondary optics because consideration must be given to defects in the secondary reflector exposed to the peak of the primary beam or cause disproportioned effects on the secondary beam.

Furthermore, alignment between the primary beam and the secondary reflector must be very accurate if accurate translation is required. Traditionally those skilled in this art overcome these problems by a combination of some or all of the following means:

i. They use less focused primary optics often requiring the use of proportionally larger secondary reflectors to compensate for "softer" primary beams, ii. compounding the complications in the manufacture and eventual mechanical support for the secondary reflector, iii. Use a more diffuse secondary reflection system to reduce the impact of defects and thus accept that the reflected beam shape and direction cannot be controlled accurately and;

iv. Use an undersized secondary reflector that intercepts only part of the primary beam which is known to be of suitably uniform intensity, thus leading to significant efficiency losses.

It is for the above reasons that conventional indirect lighting systems operate with low efficiency and poor beam control.

In the preferred embodiment shown in FIG. 2, the primary optics have been specifically designed to produce a beam with uniform intensity over a predetermined target surface. It is the use of free form optical reflector structures that provide the beam of constant intensity. This invention uses the free form optical technology to create a primary reflector designed specifically to illuminate a secondary reflector as part of an indirect lighting system. The primary reflector and light source provide a flat beam providing the following benefits;

a) It is possible to produce a more efficient primary reflector at a given size by directing more light from the lamp into the beam, b) In the practice of free form system it is normal to produce multiple overlapping images of the lamp in the beam, reducing the impact of individual defects of the primary reflector on the resultant beam. This averaging effect ensures much more consistent performance from sample to sample, c) The uniform intensity of the primary beam enables the whole surface of the secondary reflector to be used effectively, d) It is possible to accurately match the shape of the primary beam to the shape of the secondary reflector. Conventional optics produce approximately circular or trapezal beams.

Figure 7:
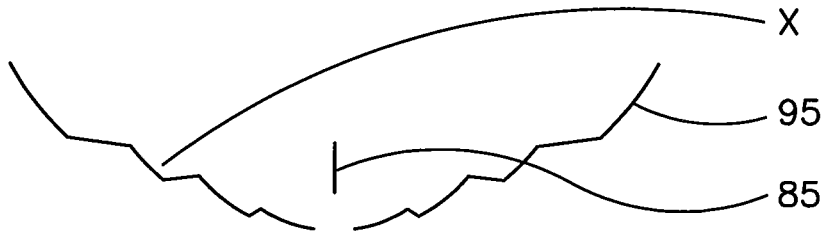
FIG. 7 is a sectional view of a free form reflector forming part of the indirect lighting system.
Figure 8:
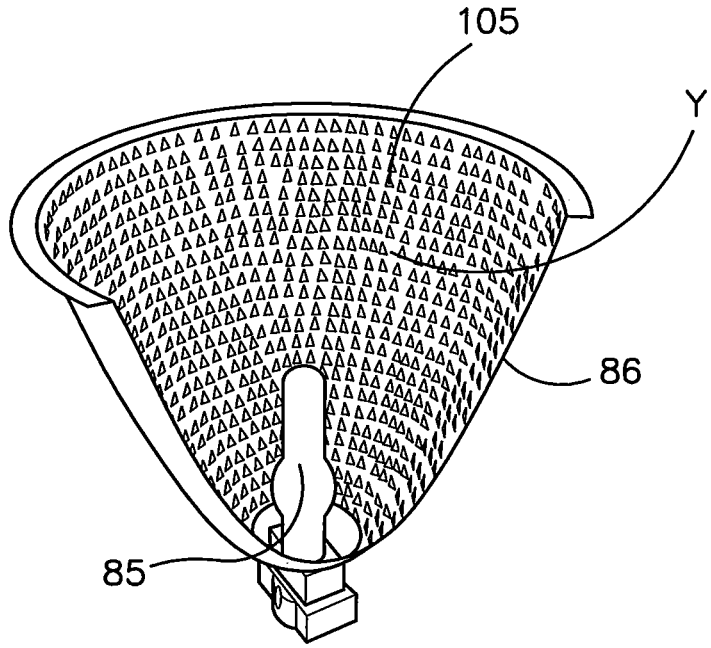
FIG. 8 is a perspective view of another form of free form reflector.

As shown in FIG. 7, the preferred form of free form reflector used in the primary optics has stepped facets 95 arranged in an arced form on either side of a light source 85. In FIG. 8 a parabolic reflector 86 is provided to surround the light source 85 but the parabolic reflector also includes small facets 105 on its interior surface. The facets are created through free form design and are specifically angled and located to provide the desired uniform intensity of the exeunt flat beam.

Secondary Optics

The secondary optics also use free form optical design tools to produce a secondary reflector that redirects profile and redirects the light from the primary beam into a secondary beam of any practically desired shape. Free form reflector systems can be used to develop the geometry for the surface to reflect light only and exactly where needed illuminating much of the losses due to the effects described earlier that are unavoidable in practical application or conventional geometric reflectors.

Theoretically a free form secondary reflector for an indirect lighting system can be accomplished with primary beams of any type. However is only possible to create a practical and efficient "fractal" design for the secondary reflector as will be described hereafter if the primary source produces uniform illumination on the secondary reflector. Such uniform illumination may be obtained from sunlight for heliostats, but must be produced for indirect lighting system by either using only a small section of a pencil beam or all of a flat beam.

If the secondary reflector is illuminated according to the present invention it is possible to treat each area of the secondary reflector surface as identical from both computational and manufacturing perspectives.

Figure 3:
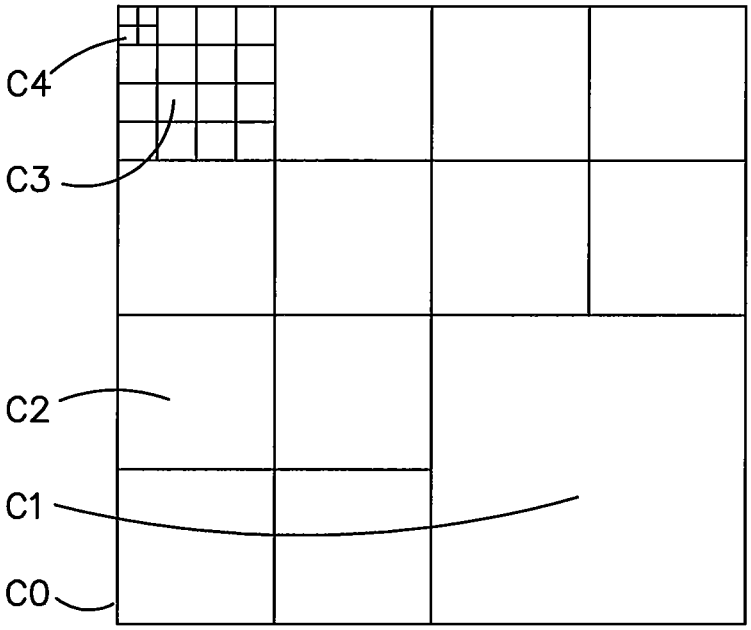
FIG. 3 is a plan view of a secondary reflector of the indirect lighting system of FIG. 2 illustrating a fractal cell array.

The underlying concept to create a fractal reflector system is illustrated in FIG. 3. The rectangle CO represents a plan view of the surface of the secondary reflector (30). Repeatedly subdividing the surface it into smaller units of the same geometrical proportions that fully abut each other effective reverse the more common fractal process of creating a large complex shape for smaller self-similar entities.

For clarity rectangles are used in FIG. 3 such as C1, and then into another sub array of "C2" as shown it is clear that the underlying geometry remains the same regardless of scale. The surface subdivision can be accomplished through several geometric shapes; rectangles, triangles and hexagons work particularly well.

Two key aspects that function in concert to deliver the required result.

Each scale of subdivision cells shown as C0, C1, C2, C3 and C4 produces the complete secondary beam profile required by the specific application. This possible because the optical geometry's vector solution is valid regardless if it is scaled to fit the whole secondary reflector or a cell of any arbitrary size.

Each of the cells regardless of its coordinate position on the secondary reflector produces the complete secondary beam profile required by the specific application. This is in contrast to conventional reflectors where each coordinate of a reflector surface directs light into a discrete direction.

This fractal subdivision process can be repeated as many times as required. In the preferred embodiment the smallest cell size is determined by the chosen reflector production technology that best meets the objectives of the application. In general the cost to manufacture precision optical devices falls much faster than the size of the object, making it much more economical to produce multiple small reflector units than a single large unit.

The invention introduces significant advantages in the manufacturing process.

The dimensions of the fractal cell (C4) cell can be chosen to suit a manufacturing process appropriate to the required level of optical precision—practically independent of the final size or shape of the secondary reflector.

The process of manufacturing large reflectors fundamentally changes from producing a small number of large expensive parts, to mass production.

A large variety of manufacturing process and materials are available to mass-produce small precision parts.

Industrial capacity to mass-produce small precision parts is large and highly prize competitive a) The "averaging" effect of defects across the large number of fractal cell reflector modules reduces the impact of individual defects. Thus significantly reduced requirements for individual component precision are needed compared to that for manufacturing single secondary reflector.
b) The structural stability of small parts tends to be better, allowing significant reductions in mass and hence cost and complexity of the secondary reflector support structure.
c) Producing customized beams for special applications becomes economically feasible
d) Secondary reflectors modules produced by different production processes can be mixed in one application—the most common reflector modules may be produced in multi cavity injection molding machines, while others required in smaller numbers can be cast or vacuum formed.
e) Reflector array modules can be designed to interlock into each other and the support structure on assembly, ensuring very high levels of precision can be attained without the need for specialist assembly line staff The invention also introduces significant advantages in the application design process. A free form secondary beam enables the optical designer to shape the light distribution onto the target at will, and that bring the following major advantages:

a) Geometrically complex areas can be illuminated efficiently by directing using otherwise wasted light into the desired area.
b) Illumination intensity distributions can be controlled more accurately, eliminating "hot spots" in the illuminated field that tend to attract the eye and make the surrounding areas appear dark.
c) Glare and spill light can be controlled much more effectively
d) Significantly more precise optics can be designed due to the higher confidence that it can be produced accurately and economically.
e) A series of different secondary beam patterns can be designed to overlap and integrate seamlessly to illuminate geometrically complex and indefinitely large areas.

FIG. 2 illustrates a typical embodiment of an indirect lighting system 80 that incorporate an enclosure 82 providing suitable accommodation for a primary optical system comprising at least a light source 85 and primary reflector 86. An optional transparent shield 81 (shown displaced for clarity) provides environmental protection for the primary optical system, and an optional louver 84 provides protection for people from viewing the primary directly from most angles. A structure 83 supports the secondary reflector in a position advantageous to intercept the light beam projected by the primary optics.

The secondary reflector may be suspended in the light beam by other means independent from the primary optics, the primary optics may itself be suspended from another structure. The whole system may also be inverted or set at any angle with the only prevision that the secondary reflector is position to intercept the beam from the primary optics at a distance and angle to ensure that the resultant reflected beam meet the requirements of the particular design.

Figure 4:
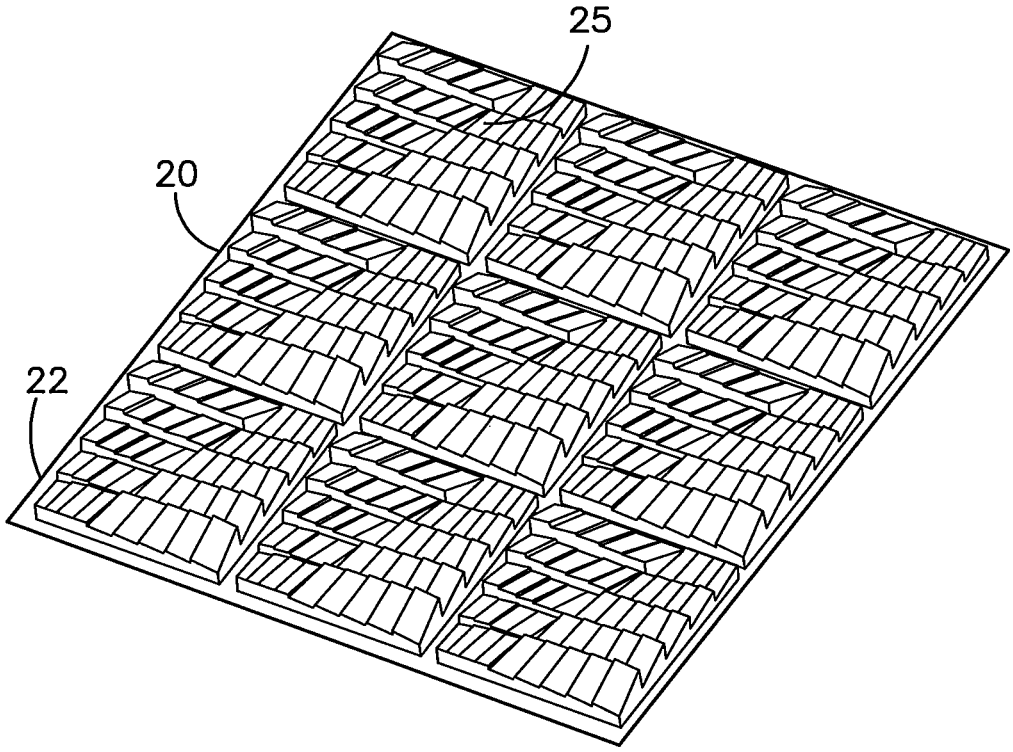
FIG. 4 is a perspective view showing the fractal cell array in greater detail.
Figure 5:
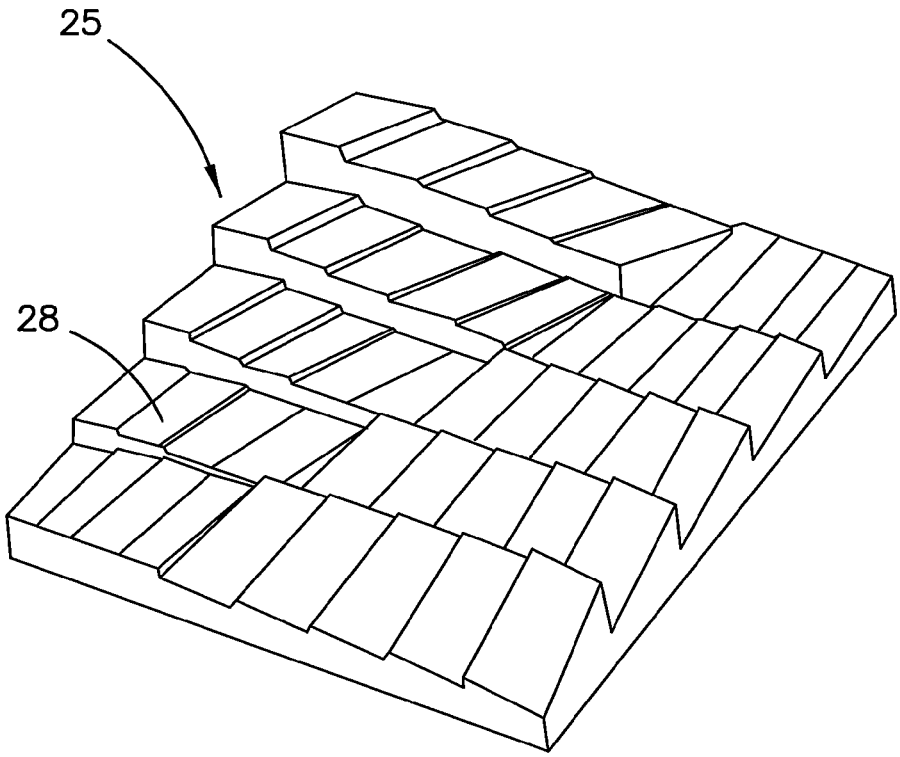
FIG. 5 is a perspective view of a module of the fractal cell array.
Figure 6:
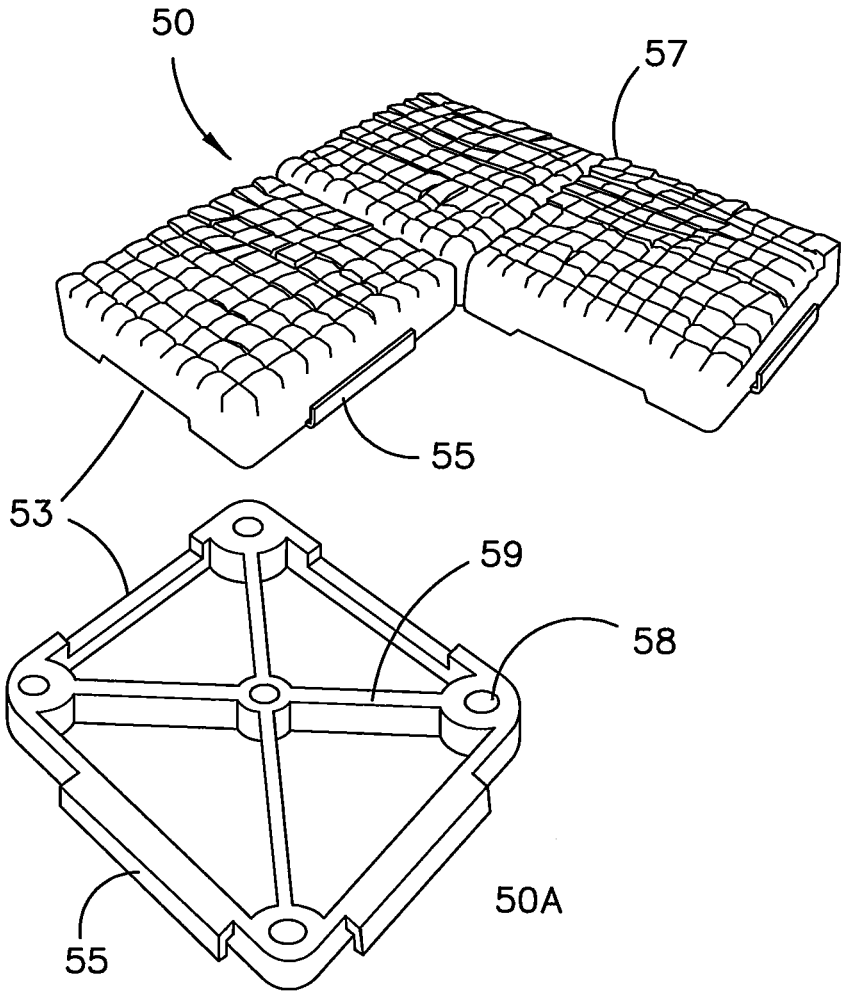
FIG. 6 is a perspective view illustrating interlocking fractal modules.

The reflective surface of the secondary reflector 87 hidden from the perspective used in FIG. 2 is described in some detail by FIG. 4. This illustration shows that the group of self-similar reflector modules 25 is arranged in an array 20. The individual modules 25 are affixed onto a support 22 of suitable design for the intended application. FIG. 6 shows a single "fractal reflector" module 25, and it is of particular note that the surface of this module is represented by an arrangement of facets 28, each set at a specific angle. These facets 28 are the active reflective surfaces of a free form reflector. Such a module can be manufactured accurately through injection molding, vacuum forming and direct machining. Materials suited to the fabrication would be any of the dimensionally stable thermoplastics, thermo set plastics, resins or metal.

It is normal practice to produce the module 28 in a material suited to the application environment and required production volume; this basic module would then be prepared according to known process for coating with a material that is highly reflective. The coating is preferably on the external surface and protected against corrosion by a transparent silicon polymer coat of less than the wavelength of light such through known processes. It is also possible to manufacture the module from a transparent material and coat the inner surface as described in the prior art. But this option requires light to transit the thickness of the transparent material twice via different paths. It introduces not only additional transmission losses, but also refractions according to the specific transparent material and the path length and geometry that must be accommodated in the design of each of the multitude free form facets.

Assembly of an array of reflector modules 25 can be complex, and the following aspects are of particular importance when assembling large reflector arrays:

a) The azimuth orientation of each module must be correct to ensure that all the secondary beams project into the desired direction.
b) The modules must assemble into a single continuous surface to receive the projected primary beam and project the secondary beam at the desired angle; this surface may be a plane or curved in one or more planes. Errors in this aspect are geometric and their effect grows very large over distance.

c) The modules must abut as close as possible to minimize the area of the secondary reflector that does not contribute to the projected beam.

d) It is desirable to minimize and preferably eliminate fixing hardware from the active surface area of the reflector array.

The preferred embodiment of a fractal reflector module as shown in FIG. 6 address all of these issues through a system of interlocking features and fixing points fabricated as part of the module. Three modules 50 are shown to a supporting surface in the assembled and interlocked condition but not affixed (with the reflecting surface facing the observer).

One module 50A is shown inverted for clarity. Each fractal reflector module has a series of interlock receptacles 53 and interlock protrusions 55.

The disposition and dimensions of these interlocking elements 53 and 55 are designed by a skilled practitioner to ensure that when multiple modules are assembled no part of the interlock system is visible from the reflective face of the array 57—with the exception of the final perimeter of the array. The interlocking features are also designed not to interfere with the surface onto which the modules are attached, and that there is sufficient tolerance to prevent the normal production variations in dimension from module "stacking up" and ultimately preventing an array of desired dimensions from being assembled.

Provision for attachment of the modules to a suitable surface can also be made by a skilled practitioner—the example shows screw fixing holes 58 can be provided and structural ribs 59 that may also create surfaces suitable for adhesives. This will enable invisible fixing without risk damage to the reflective surface.

As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. An indirect lighting system adapted to direct light to a target, the system comprising:

primary optics arranged to eject a flat beam of uniform intensity light onto secondary optics that reflect the beam to the target, the primary optics comprising a light source and a reflector of stepped facets the shape and location of each facet being calculated to provide a uniform intensity flat beam, the secondary optics comprising a free form reflector of fractal design.

2. The indirect lighting system according to claim 1 wherein the secondary optics comprises an assembly of fractal reflector modules.

3. The indirect lighting system according to claim 1 wherein the stepped facets of the primary optics are located on the surface of a parabolic reflector.

4. The indirect lighting system according to claim 1, wherein a transparent shield is positioned over the primary optics.

5. An indirect lighting system according to claim 1, wherein a louver or grid is positioned between the primary optics and the shield.

6. The indirect lighting system according to claim 1, wherein a housing contains the primary optics shield and grid and the secondary optics are supported on a column extending above the housing.

* * * * *